US007737350B2

(12) United States Patent
Wanne

(10) Patent No.: US 7,737,350 B2
(45) Date of Patent: Jun. 15, 2010

(54) UNIVERSAL LIGATURE SUITABLE FOR MANY INSTRUMENTS

(76) Inventor: Allen Theodore Wanne, 118 Sudden Valley, Bellingham, WA (US) 98229

( * ) Notice: Subject to any disclaimer, the term of this patent is extended or adjusted under 35 U.S.C. 154(b) by 0 days.

(21) Appl. No.: 12/123,652

(22) Filed: May 20, 2008

(65) Prior Publication Data

US 2009/0288544 A1 Nov. 26, 2009

(51) Int. Cl.
*G10D 9/02* (2006.01)

(52) U.S. Cl. ..... 84/383 A

(58) Field of Classification Search ..... 84/380 R, 84/383 R, 383 A

See application file for complete search history.

(56) References Cited

U.S. PATENT DOCUMENTS 3,618,440 A * 3/1970 Ratterree ..... 84/173
4,991,483 A * 2/1991 Petit ..... 84/383 R
2008/0083316 A1* 4/2008 Wanne ..... 84/398

OTHER PUBLICATIONS

Ligaphone; roger petiit; www.ligaphone.com; Dec. 9, 2003.*

* cited by examiner

*Primary Examiner*—Kimberly R Lockett
(74) *Attorney, Agent, or Firm*—Gottlieb, Rackman & Reisman, P.C.

(57) ABSTRACT

A mouthpiece assembly includes a tubular member and a ligature for attaching a reed to the tubular member. The ligature is structured to be infinitely adjustable in size as selected by a musician to fit many different sized woodwind mouthpieces.

16 Claims, 3 Drawing Sheets

UNIVERSAL LIGATURE SUITABLE FOR MANY INSTRUMENTS

RELATED APPLICATIONS

None

BACKGROUND OF THE INVENTION

A. Field of Invention

This invention pertains to musical instruments with removable mouthpiece assemblies, and more particularly to a novel assembly wherein the ligature is adjustable to fit many differing sized mouthpiece assemblies.

B. Description of the Prior Art

Woodwind instruments are instruments consisting of a tubular body used to define a column of air. As is well known in the art, sound waves are produced within the column of air and the musical characteristics of the sounds, including pitch, volume and other characteristics are modulated by changing the acoustic characteristics of the column. More specifically, a mouthpiece is attached by a friction fit to an end of the tubular body. The mouthpiece has a cavity in communication with the interior of the tubular body. A reed covers the cavity and is arranged so that when a musician blows through the mouthpiece, the reed oscillates and produces vibrations which are then propagated through the cavity in the mouthpiece to the tubular body. The reed is secured to the mouthpiece by an adjustable metal band known as the ligature.

The ligature normally extends circumferentially around the entire outer body of the mouthpiece. The ligature is provided with an integral tightening mechanism that is used to secure the reed to the mouthpiece. Because of the mechanical coupling between the ligature, the mouthpiece and the reed, the structure of the ligature plays a role in the sound produced by the instruments, and various types of ligatures are available from different companies, each having its own sound characteristics. FIGS. 4 and 5 show some known prior art mouthpieces and ligatures for saxophones.

SUMMARY OF THE INVENTION

Briefly, the present invention pertains to a musical instrument including an elongated instrument body having a mouthpiece at one end; a reed; and a ligature mounting the reed on the elongated body. The ligature includes a ligature body and a band having an adjustable length and passing around the mouthpiece. The length of the band is set to conform to a dimension of the mouthpiece.

In another aspect of the invention, the mouthpiece has a generally tubular shape and includes a band receiving area of a predetermined diameter for receiving the band, wherein the band is adjusted in length to conform to the predetermined diameter. The band has a first end fixedly attached to the ligature body and a second end. The ligature body includes a band receiving member receiving and selectively capturing the second end to set the band length to suit the diameter of the band receiving zone.

In another aspect of the invention, instrument includes a tightening mechanism to tighten the band. The tightening mechanism may include a thumbscrew that is selectively advanced toward the instrument body and a plate attached to said thumbscrew and forming an interference fit with said instrument body.

In another aspect of the invention, the ligature body is elongated and is mounted transversally to the instrument body.

The present invention further pertains to a ligature for selectively attaching a reed to one of several musical instruments, each instrument having a respective several instrument bodies with a ligature receiving zone having a receiving zone dimension. The receiving zone may have different diameter for different types of instrument bodies. The ligature includes a ligature body with a band securing member; a flexible band having a first band end fixed to said body and a second band end received by said band securing member at a securing position that is adjustable to adjust the length of said band, said flexible band being sized and constructed to fit around a respective instrument body at the receiving zone; and a reed attaching member attached to the ligature body and being constructed and arranged to attach the reed to said instrument body.

Preferably, the ligature body has an elongated shape with first and second opposed body ends. The first end is attached to a first body end and the band securing member is near said second body end.

In one aspect of the invention, the band securing member includes a hole receiving the second band end and a securing part attaching the second band end at a position dependent on the dimension of the ligature receiving zone.

In one aspect of the invention, the ligature has a diameter equal to the dimension of the receiving zone.

In one aspect of the invention, the reed attaching member includes a screw reciprocates radially with respect to the ligature body and is adapted to selectively attach the ligature to the instrument body.

DETAILED DESCRIPTION OF THE INVENTION

Figure 4:
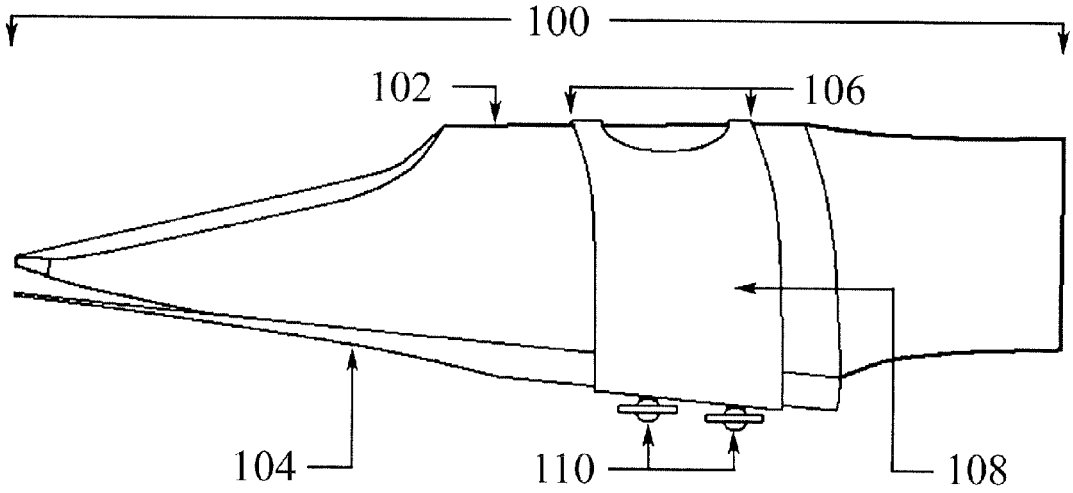
FIG 4 PRIOR ART
FIG. 4 shows a side view of a mouthpiece with a prior art ligature.

In order to provide a better understanding of the invention, some prior art ligatures are first discussed. Referring first to FIG. 4, a typical mouthpiece 100 is shown with a reed 104. The reed 104 is secured to the mouthpiece 100 with a ligature 106. Ligature 106 has a fixed band 108 disposed around mouthpiece 100. The band 108 is tightened with two screws 110 which hold the reed. All prior ligatures have a fixed band length, and as such only fit one size of mouthpiece. Different sized mouthpieces require appropriately sized ligatures.

Figure 5:
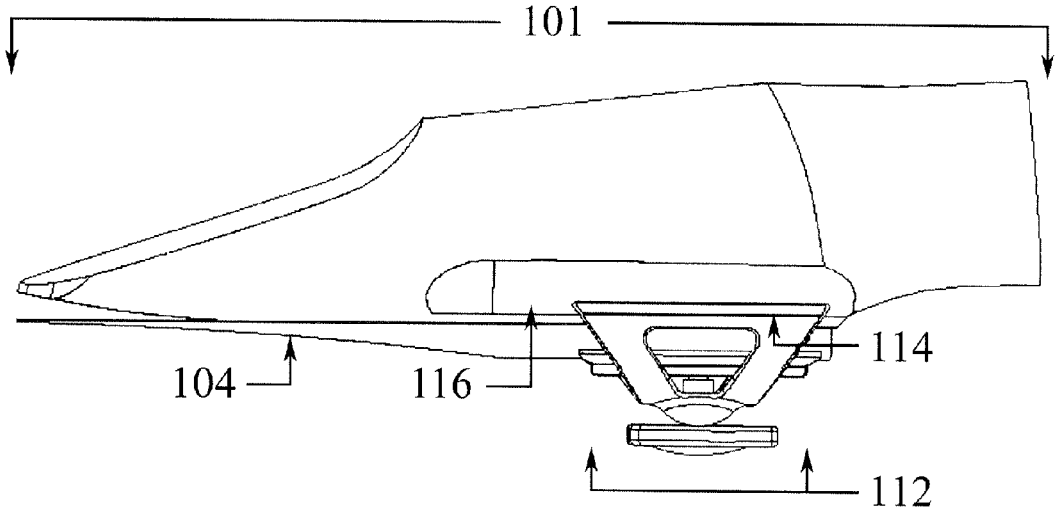
FIG 5 PRIOR ART
FIG. 5 shows a side view of a mouthpiece with another type of prior art ligature.

Referring to FIG. 5, mouthpiece 101 is shown with the reed 104. The reed 104 is secured to mouthpiece 101 with a ligature 112. Ligature 112 has a protrusion 114 that is pressure fit into indentation 116 on mouthpiece 101. Ligature 112 is built specifically for mouthpiece 101 and as such only fits this specific mouthpiece.

Also, in the attempt to hold the ligature in place, some prior art ligatures utilize large surface areas of tight contact with the mouthpiece body 102. The vibrations of the reed/ligature combination are dampened by the mouthpiece body 102 creating a deadening effect on the resultant sound produced by the mouthpiece.

Figure 1:
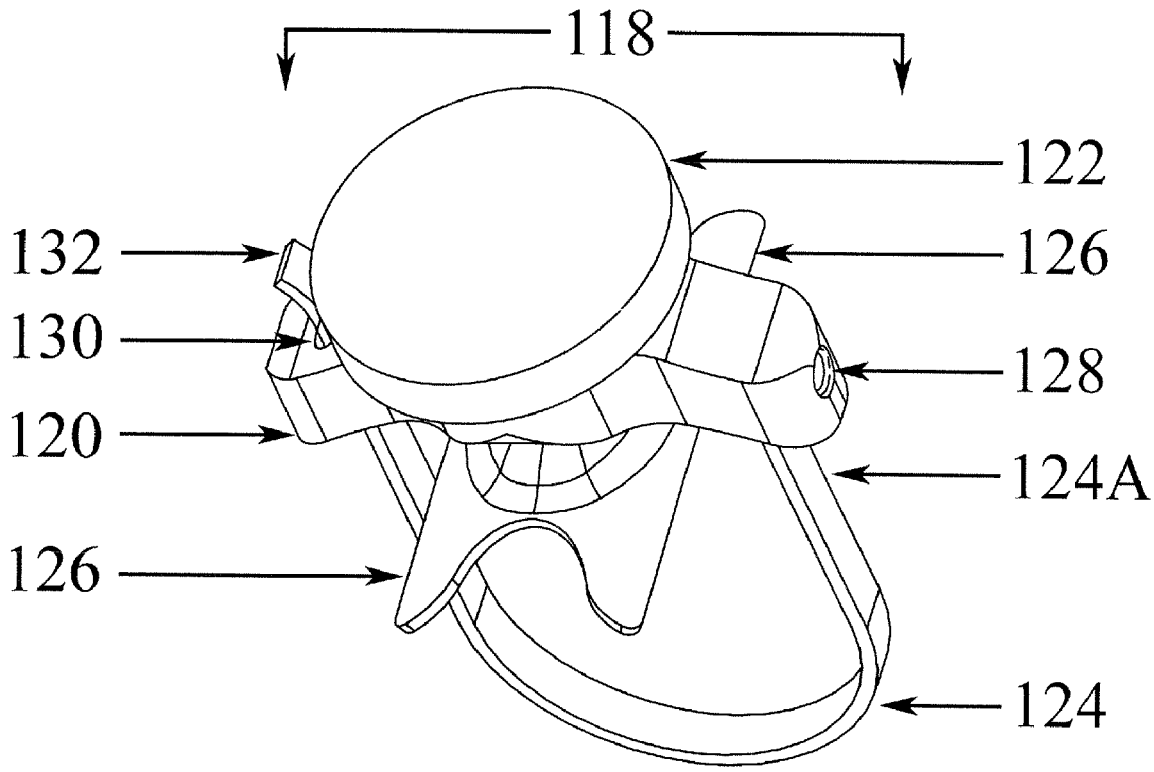
FIG. 1 shows an orthogonal view of a ligature constructed in accordance with this invention.
Figure 2:
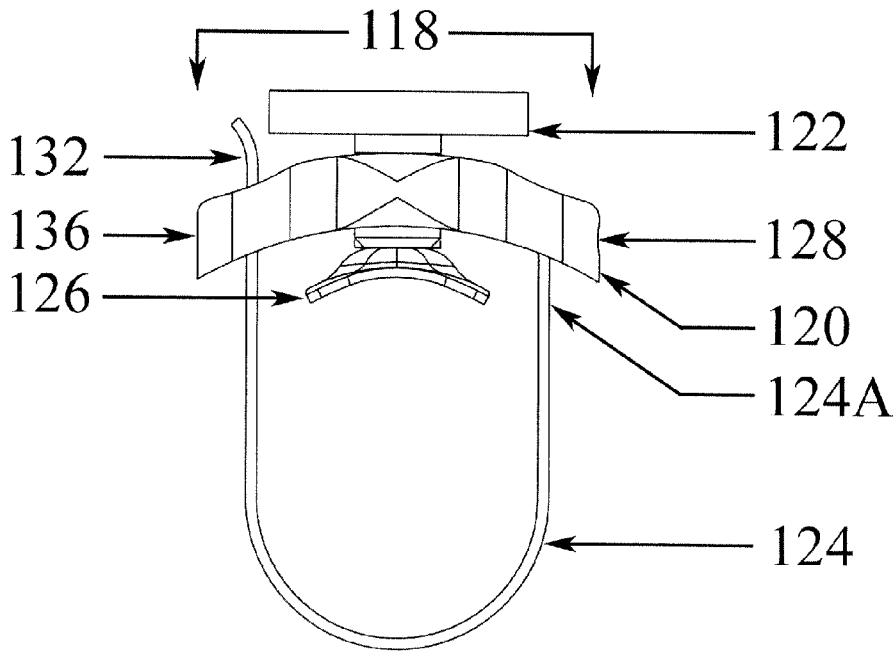
FIG. 2 shows a front view of a ligature constructed in accordance with this invention.
Figure 3:
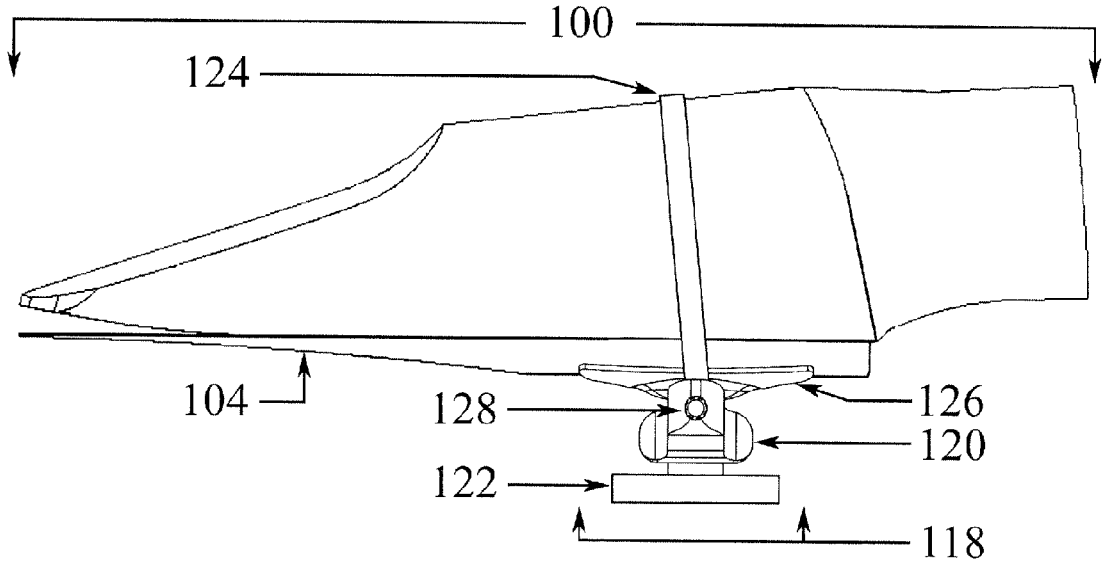
FIG. 3 shows a side view of a mouthpiece with the ligature of FIG. 1.

The invention provides a ligature 118 shown in FIGS. 1-3 having of a ligature body 120, a thumbscrew 122, an adjustable band 124, and a pressure plate 126. The body has a generally elongated shape. The band 124 has one end 124A which is fixed into an inset on one side of the body 120 with a set-screw 128. Alternatively, end 124A may be permanently fixed by soldering or similar methods to one end of the body 120. The opposite end of the band 124 slides through a hole 130 in the opposite end of the body 120. The ligature is adjusted to fit any mouthpiece by sliding an end portion 132 of the band 124 through hole 130 thereby expanding or contracting the size or length of the band 124. The band 124 is preferably made of steel or brass and is flexible, although it could be made from other materials as well.

Once the ligature is seated on the respective mouthpiece, the band 124 is tightened by advancing the end 132 through the hole 130 and securing the end 132 to the body 120. This may be accomplished using an adhesive inserted into the hole, a set-screw 136 (or thumb screw) threaded through the side of body 120 and having a tip engaging the end 132. Alternatively, the end 132 and hole 130 are sized and shaped to provide an interference fit there-between. Once the length of band 124 forming the loop engaging the mouthpiece body is set, the tip of end 132 extending above the body 120 can be cut off to insure that it does not interfere with the operation of the musical instrument. Alternatively, the length of the band is set (e.g., its second end 132 is secured to the body 120) before the ligature is disposed on the mouthpiece.

Since the band of the invention is adjustable in length it fits all mouthpieces regardless of width, diameter or shape, including mouthpiece body types 100 and 101 shown in FIGS. 4 and 5. Therefore the thumbscrew 122 and pressure plate 126 are used in the same manner as in the prior art ligatures as shown in FIG. 5 to engage and lock the ligature unto the body of the mouthpiece 100, as clearly illustrated in FIG. 3. More specifically, once the ligature is mounted or positioned on the mouthpiece 100, turning the thumbscrew 122 clockwise causes the plate 126 to advance radially thereby tightening the band 130 and causing the ligature and the reed 104 to be firmly secured to the mouthpiece Numerous modifications can be made to the invention without departing from the scope defined in the appended claims. For example, band 124 may be fixed at one end 124A by various fashions. End 124A may also be allowed to move freely through body 120 as is evident on the other end of the band 124 through hole 130. Whether one end or both ends of band 124 move freely through body 120 is incidental as the invention only requires that the band be adjustable through 120. The invention does not require it be done in any particular way.

I claim:

1. A musical instrument comprising:

an elongated instrument body having a mouthpiece at one end;

a reed; and a ligature mounting said reed on said elongated body, said ligature including a ligature body; a band having an adjustable length and passing around said mouthpiece, wherein the length of the band is set to conform to a dimension of the mouthpiece; and a screw mounted on said ligature body and reciprocating radially therethrough to selectively secure said reed to said instrument body and to tighten said band thereby securing said ligature to said body.

2. The instrument of claim 1 wherein said mouthpiece has a generally tubular shape and includes a band receiving area of a predetermined diameter for receiving said band, wherein said band is adjusted in length to conform to said predetermined diameter.

3. The instrument of claim 1 wherein said band has a first end fixedly attached to said ligature body and a second end, and wherein said instrument body includes a band receiving member receiving and selectively capturing said second end to set said band length.

4. The instrument of claim 1 wherein said screw is a thumbscrew that is selectively advanced toward said instrument body and wherein said instrument further includes a plate attached to said thumbscrew and forming an interference fit with said instrument body.

5. The instrument of claim 1 wherein said ligature body is elongated and is mounted transversally to said instrument body.

6. A ligature for selectively attaching a reed to a musical instrument having one of several instrument bodies, said instrument bodies having a ligature receiving zone with a receiving zone dimension that differs from type of instrument body to another, said ligature comprising: a ligature body with a band securing member; a flexible band having a first band end fixed to said ligature body and a second band end received by said band securing member at a securing position that is adjustable to adjust the length of said band, said flexible band being sized and constructed to fit around a respective instrument body at said receiving zone; and a reed attaching member attached to said ligature body and being constructed and arranged to attach said reed to said instrument body; wherein said reed attaching member includes a thumb screw reciprocating radially through said band and adapted to attach said reed to said instrument body, said thumb screw being further adapted to tighten said band about the one of several instrument bodies thereby securing said ligature on said one of said instrument bodies; and wherein said ligature further includes a set screw reciprocating through said band securing member to selectively capture said second band end.

7. The ligature of claim 6 wherein said ligature body has an elongated shape with first and second opposed body ends, with said first end being attached to said first body end and said band securing member being disposed at least near said second body end.

8. The ligature of claim 6 wherein said band securing member includes a hole receiving said second band end and said set screw is adapted to capture said second band end at a position dependent on said dimension.

9. The ligature of claim 7 wherein said dimension is a diameter of said receiving zone.

10. The ligature of claim 6 further comprising a plate attached to said screw and contacting said reed.

11. The ligature of claim 6 wherein said band is made of a flexible metallic material.

12. The ligature of claim 6 wherein said band has an infinitely adjustable length.

13. A ligature for mounting a reed on a musical instrument comprising:

a ligature body; and a flexible band having first and second ends attached to said ligature to form a ring having a circumference that approximates a circumference of said musical body; so that said ligature body and band are positioned around said musical instrument;

wherein said ligature body includes a reed attaching member, said reed attaching member including an attaching screw that is selectively movable in a radial direction to for attaching said reed to said instrument body, said attaching screw being arranged to tighten said band at the time that said attachment screw attaches said reed to said instrument body.

14. The ligature of claim 13 wherein said band has a variable length.

15. The ligature of claim 14 wherein said band and said ligature body each include a first end and a second end, said first band end being secured to said first ligature body end, and said second band end being secured to said second ligature body end.

16. The ligature of claim 15 wherein first band end is fixed to said ligature body and said ligature body further includes a set screw for capturing said second band end.

* * * * *